US005535805A

United States Patent [19]

Kellogg et al.

[11] Patent Number: 5,535,805

[45] Date of Patent: Jul. 16, 1996

[54] OVERHEAD DOOR

[75] Inventors: Kurt A. Kellogg, Bloomington, Minn.; Michael I. Tich, Baltimore, Md.; William A. Schirado, Plymouth; Gregory D. Yarke, St. Francis, both of Minn.

[73] Assignee: HPD International, Inc., Brookfield, Wis.

[21] Appl. No.: 198,832

[22] Filed: Feb. 18, 1994

[51] Int. Cl.[6] ..... E05D 15/16

[52] U.S. Cl. ..... 160/201; 160/281; 16/87 R

[58] Field of Search ..... 16/87 R, 102, 16/89, 90, 93 R, 96 R; 160/201, 264, 310, 133, 280–289, 276; 292/DIG. 36

[56] References Cited

U.S. PATENT DOCUMENTS

| | | | |
|---|---|---|---|
| D. 245,266 | 8/1977 | Gorse | D25/99 |
| 1,787,451 | 1/1931 | Mohun et al. | 160/282 |
| 4,452,293 | 6/1984 | Gorse | 160/232 |
| 4,676,293 | 6/1987 | Hanssen | 160/201 |
| 4,880,045 | 11/1989 | Stahler . | |
| 5,025,847 | 6/1991 | Mueller | 160/270 |
| 5,139,075 | 8/1992 | Desrochers | 160/310 |
| 5,141,043 | 8/1992 | Kraeutler | 160/264 |
| 5,141,044 | 8/1992 | Hying et al. | 160/271 |
| 5,163,494 | 11/1992 | MacNeil et al. | 160/201 |
| 5,219,015 | 6/1993 | Kraetler | 160/271 |
| 5,222,541 | 6/1993 | Hornberger | 160/265 |

FOREIGN PATENT DOCUMENTS

| | | | |
|---|---|---|---|
| 247856 | 12/1960 | Australia | 292/DIG. 36 |

*Primary Examiner*—Blair M. Johnson
*Attorney, Agent, or Firm*—Godfrey & Kahn

[57] ABSTRACT

An overhead door for a structure which includes a pair of tracks having inwardly facing surfaces which define a channel, and wherein the channels are mounted in predetermined substantially parallel spaced relation one to the other, a door panel located intermediate the pair of tracks and moveable along a predetermined path of travel which is defined by the pair of tracks, and a release assembly borne by the door panel and operable to releasably engage at least one of the tracks, the release assembly including a moveable plunger which is received in the channel of one of the tracks and which guides the door panel along the path of travel and which further becomes disengaged from the channel when force of a predetermined magnitude is applied to the door panel.

11 Claims, 5 Drawing Sheets

OVERHEAD DOOR

FIELD OF THE INVENTION

The present invention relates to an overhead door and more specifically, to an overhead door which is guided along a predetermined path of travel by a pair of tracks, and which further is operable to disengage from the individual tracks when exposed to force of a predetermined magnitude thereby preventing damage to the door, tracks, and surrounding supporting structures.

DESCRIPTION OF THE PRIOR ART

The beneficial affects of employing various overhead door assemblies for use in occluding openings in structures such as warehouses, factories and the like have long been known. For example, impact-resistant overhead doors such as those illustrated in U.S. Pat. No. 4,676,293 to Hanssen, and U.S. Pat. No. 5,025,847 to Mueller, have utilized various assemblies which have been designed to resist the force of impact thereby preventing damage to the door and surrounding structure.

While these and other prior-art structures have operated with some degree of success, they have several shortcomings which have detracted from their usefulness. More specifically, and with respect to the impact resistant assemblies which are shown in Mueller, U.S. Pat. No. 5,025,847, these assemblies, while operable to release from an associated track upon being exposed to force of a predetermined magnitude, are, in short, unduly cumbersome, and complex in their mechanical arrangement. These complex door designs, of course, greatly increase the cost of manufacturing and the maintenance of same. Further, and as best appreciated following a study of U.S. Pat. No. 5,222,541 to Hornberg, the release assembly disclosed in this patent while finding usefulness with specific types of overhead doors, such as industrial roll-up doors, has not been rendered useful for all types of overhead doors such as doors which are manufactured from ridged, articulated panels.

A further shortcoming with the various prior art devices which are designed for substantially the same purposes is that these same assemblies often do not reliably release under all environmental circumstances thereby resulting in damage to the door or surrounding assemblies or structures, or in the alternative, a workman must spend time with various tools to reset, or otherwise readjust the door following impact.

Still a further shortcoming with the prior-art assemblies relates to the direction in which the door will release when exposed to force. In this regard, many prior-art door assemblies will only release in a specific direction. Consequently, significant damage to the door will result if force is applied from the opposite direction.

Therefore, it has long been known that it would be desirable to have an improved overhead door which reliably moves along a predetermined path of travel to selectively occlude an opening in a structure, and which further will release from an associated track when exposed to force of a predetermined magnitude thereby substantially preventing damage to the overhead door, track, or surrounding structure.

SUMMARY OF THE INVENTION

Therefore, it is an object of the present invention to provide an improved overhead door.

Another object of the present invention is to provide an overhead door which may be manufactured and installed as original construction or which may further be manufactured or installed in the nature of a replacement door.

Another object of the present invention is to provide an overhead door which may be readily installed or integrated with other door assemblies, such as motorized door opening assemblies, counterweight devices, and doors of both solid, articulated panel, and synthetic fabric-type construction.

Another object of the present invention is to provide an overhead door which is readily adaptable to nearly all common, commercial building designs.

Another object of the present invention is to provide an overhead door assembly which reliably releases when exposed to force of a predetermined magnitude without damaging the associated track, or surrounding structures.

Another object of the present invention is to provide an overhead door which is operable, in one form, to reliably release when force is applied to either side of the door.

Another object of the present invention is to provide an overhead door which includes a release assembly having a plunger which is biased into an engaged position relative to an associated track, and wherein the plunger, when exposed to force of a predetermined magnitude, is operable to be urged into a disengaged position thereby reliably releasing the overhead door from the track to prevent damage to the overhead door, and the associated track.

Another object of the present invention is to provide an overhead door assembly which can be quickly, and easily placed back into operation following disengagement from the associated track assembly.

Still another object of the present invention is to provide an overhead door assembly which has an articulated, rigid panel construction, and wherein the articulated rigid panels have a light-weight construction in relative comparison to prior-art assemblies having substantially similar designs.

Further objects and advantages of the present invention are to provide improved elements and arrangements thereof in an overhead door for the purposes intended and which is dependable, economical, durable and fully effective in accomplishing these intended purposes.

These and other objects and advantages are achieved in an overhead door assembly which includes a pair of tracks which are mounted on an associated structure, each of the tracks having an inwardly facing surface which defines a channel, and wherein the individual channels are mounted in predetermined substantially parallel relation one to the other; a door panel located intermediate the pair of tracks, and movable along a predetermined path of travel which is defined by the pair of tracks; and a release assembly borne by the door panel and operable to releasably engaged at least one of the tracks, the release assembly including a moveable plunger which is received in the channel of one of the tracks and which facilitates the movement of the door panel along the path of travel and further disengages from the channel when force of a predetermined magnitude is applied to the door panel thereby preventing damage from being imparted to the door panel and the associated tracks.

DESCRIPTION OF THE PREFERRED EMBODIMENT

Figure 1:
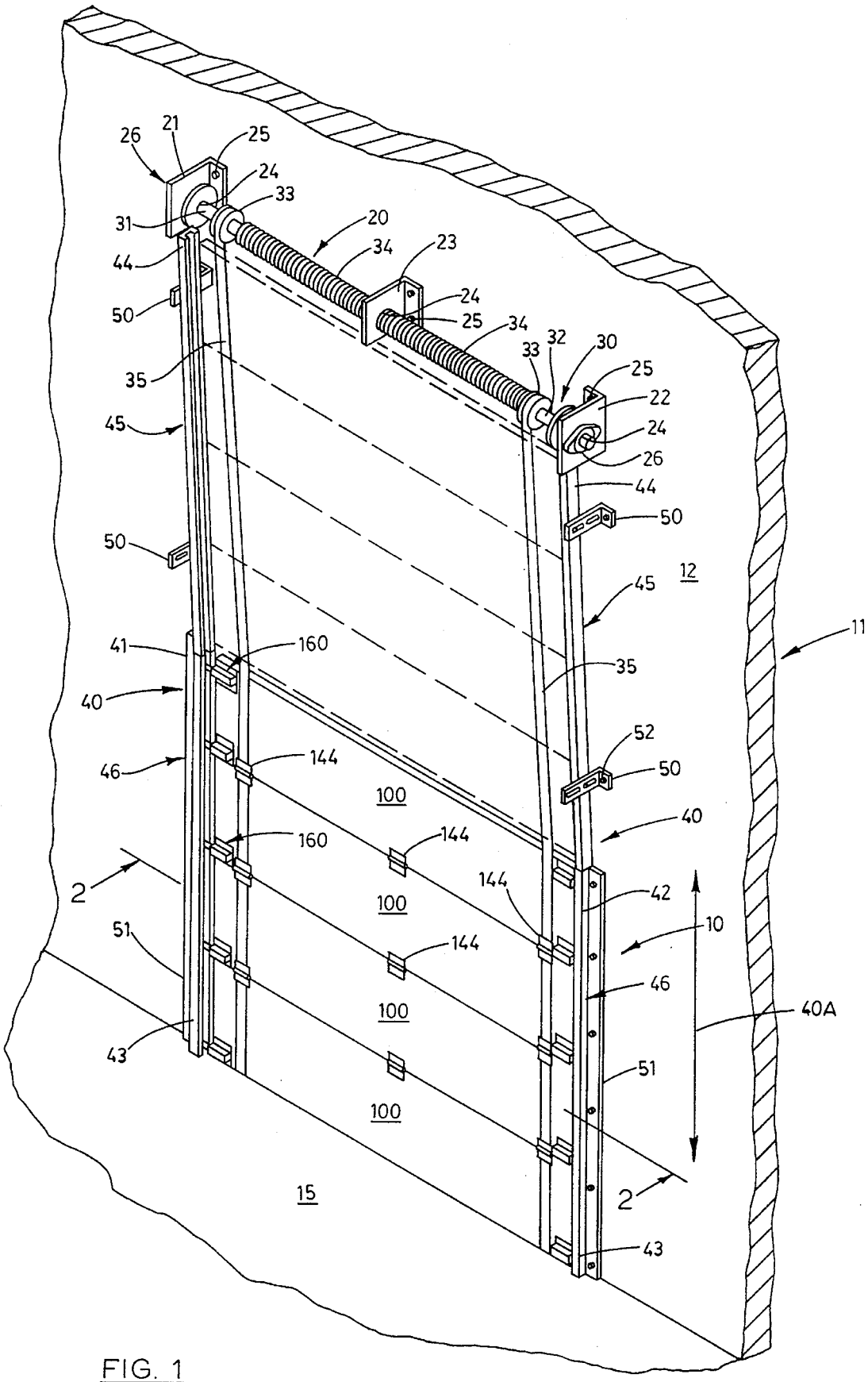
FIG. 1 is a perspective environmental view of overhead door of the present invention and which is shown in a typical operative environment.

The overhead door of the present invention is generally designated by the numeral 10, and is best understood by a study of the environmental view as shown in FIG. 1.

As best seen in FIG. 1, the overhead door of the present invention finds usefulness when installed on a building which is generally indicated by the numeral 11, and wherein the building has a wall or bulkhead 12. The wall or bulkhead has a peripheral edge 13 which defines an opening 14. The floor of the building is generally indicated by the numeral 15.

As best illustrated by reference to FIG. 1, a spring or retraction assembly, of substantially conventional design 20 is mounted in a position in predetermined, spaced relationship above the opening 14. The spring assembly 20 includes first, second and third supports brackets 21, 22 and 23, respectively, and which are mounted in predetermined spaced relation one to the other. Apertures 24, of predetermined dimensions, are formed in each of the support brackets. The individual apertures 24 are oriented in substantially coaxial alignment, one to the other. Fasteners, of conventional design 25, are operable to secure the individual support brackets in their predetermined orientation relative to the wall or bulkhead 12. A pair of bearing assemblies, which are generally indicated by the numeral 26, are mounted on the first and second support brackets and are positioned in substantially coaxial registry with the individual apertures 24 which are defined by same. An axle assembly, which is generally indicated by the numeral 30, is rotatably received in the respective apertures 24. The axle assembly 30 has a first end 31, and an opposite second end 32. The opposite ends are individually rotatably supported in the respective bearing assemblies 26. A pair of take-up pulleys 33 are secured by conventional fastening means in predetermined fixed positions in spaced relationship relative to the first and second ends 31 and 32, respectively. Further, a pair of coil springs 34, of substantially conventional design, are each fastened on the third support bracket 23, and are received about, and fastened on the axle 32, respectively. The pair of coil springs are operable, of course, to exert a rotatable biasing force on the axle thereby causing it to rotate in a predetermined direction. Typically the biasing force of the pair of springs are operable to greatly reduce the force necessary to lift or move the overhead door 10 into an open position as shown in phantom lines in FIG. 1, or otherwise permits the overhead door to be positioned at any desired location thereby selectively occluding the opening 14. A pair of cables 35 are fastened on the individual take-up pulleys and are operable to transmit force from the axle assembly to the overhead door assembly in a fashion which is well understood by those skilled in the art.

The overhead door of the present invention acts in combination with a pair of tracks 40 which are fastened on the wall 12, and which define a predetermined path of travel 40A for the overhead door 10. While the path of travel 40A is shown as a substantially linear path, it should be appreciated that the overhead door may follow a curved path of travel as where the door moves along the tracks into a position which is substantially parallel to the floor 15. This type of installation would typically be utilized in residential applications. The pair of tracks are disposed in predetermined, substantially parallel spaced relation one to the other. The pair of tracks includes a first track 41, and a second track 42 which are oriented in substantially the same plane, one with the other. Each of the tracks has a first end 43, which rests on, or near the floor 15, and further has a second end 44, which is remote thereto. Further, and as best seen in FIG. 1, the first and second tracks each have an upper portion 45, and a lower portion 46, which are positioned in end-to-end relation, and are disposed in mating registry one with the other. As best appreciated by a study of FIG. 1, the upper portion of each of the tracks 45 is supported, in predetermined spaced relation relative to the wall 12, by a pair of support brackets 50. As will be appreciated, the individual support brackets are operable to position the overhead door in angulated, spaced relation relative to the wall 12 thereby positioning the door in an advantageous orientation relative to the axle assembly 30. As noted above, in certain applications the tracks can position the overhead door in an orientation which is substantially parallel to the floor 15, (not shown). A support bracket 51 is operable to support the lower portion of individual tracks 40 in a fixed position which is substantially parallel to the surface of the wall. Individual fasteners 52 attach the respective support brackets 50 and 51 to the surface of the wall 12.

Figure 3:
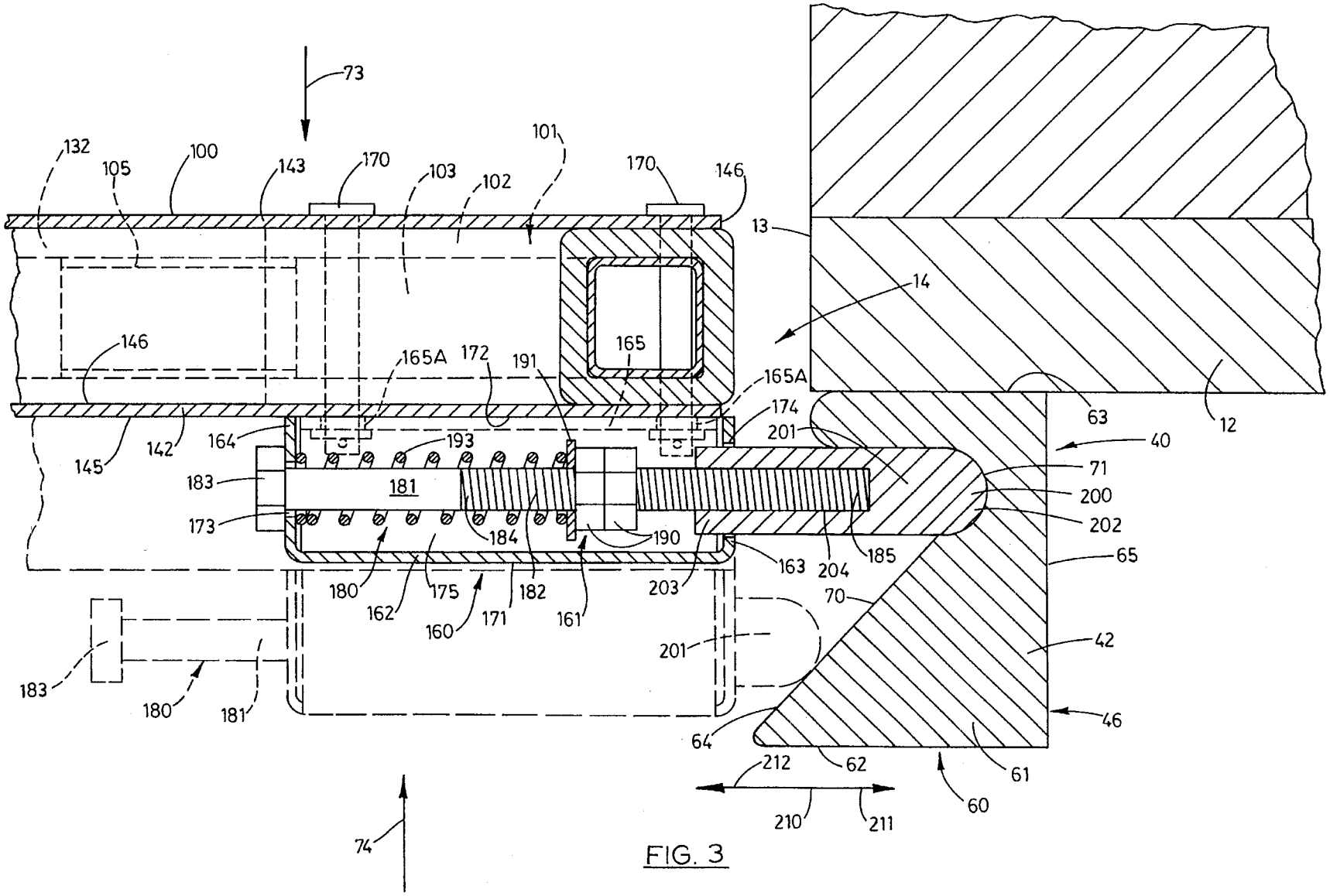
FIG. 3 is a substantially longitudinal, vertical, sectional view of a first form of the overhead door of the present invention and which is taken from a position along line 3—3 of FIG. 2.

As noted above, the overhead door 10 operates, in combination with a pair of tracks 40 each track of which is positioned in substantially parallel, spaced relation one to the other. As best seen by reference to FIG. 3, a first form of the track 60 which may be utilized with the present invention is shown. It should be understood that the first form of the track facilitates release of the overhead door 10 when force of a predetermined magnitude is applied in only one direction. The track 60 has a main body 61, which includes both forwardly and rearwardly facing surfaces 62 and 63, and inwardly and outwardly laterally disposed surfaces 64 and 65, respectively. As best seen in FIG. 1, the rearwardly facing surface is attached to the underlying support bracket 51 by means of a suitable fastening technique such as adhesives, threaded fasteners, and other means known in the art (not shown). Further, if the track is manufactured from a synthetic, polymeric-based material, the track and underlying support bracket may be extruded as an integral assembly. The inwardly facing surface 64 defines an engagement surface 70 which cooperates with a release assembly which will be discussed in greater detail hereinafter. The engagement surface 70 defines a u-shaped channel 71 which extends substantially longitudinally relative to the main body 61. As best seen in FIG. 3, the u-shaped channel is located in close proximity to the rearwardly facing surface 63, and the engagement surface slopes inwardly from the forwardly facing surface 62 towards the u-shaped channel thereby defining an inclined surface. The operation of the engagement surface 70 and its cooperation with the release assembly will be discussed in greater detail hereinafter.

As should be understood, and as best depicted in FIG. 3, the first form of the track 60 is operable to release when force is applied in the direction indicated by the arrow labeled 73. However, this same track can render the overhead door 10 operable to release in the opposite direction by merely installing the respective tracks in reversed, end-to-end orientation. More specifically, by placing the forwardly facing surface 62 against the wall 12, the overhead door will be operable to release when force is applied in the direction indicated by the arrow labeled 74. Thus, the present design permits the installer to select the direction of release without requiring additional parts. Further, the individual tracks 40 may have mixed sections, that is, sections which provide for release when struck in one direction, and further will release in the opposite direction when the overhead door 10 is oriented at a different height above the floor 15. For example, a factory may wish that the overhead door 10 release only when struck from the inside of the building 11 when the overhead door is in a fully down position thus providing security from night-time break-in; but further the overhead door may be operable to release when struck from the outside of the building when the overhead door 10 is oriented at a predetermined distance above the floor 15. Additionally, if the overhead door is installed in a fashion where the door, when open, is positioned in substantially parallel relation to the floor 15, the tracks would be oriented such that the weight of the overhead door would not cause the overhead door to release from the respective tracks.

Figure 5:
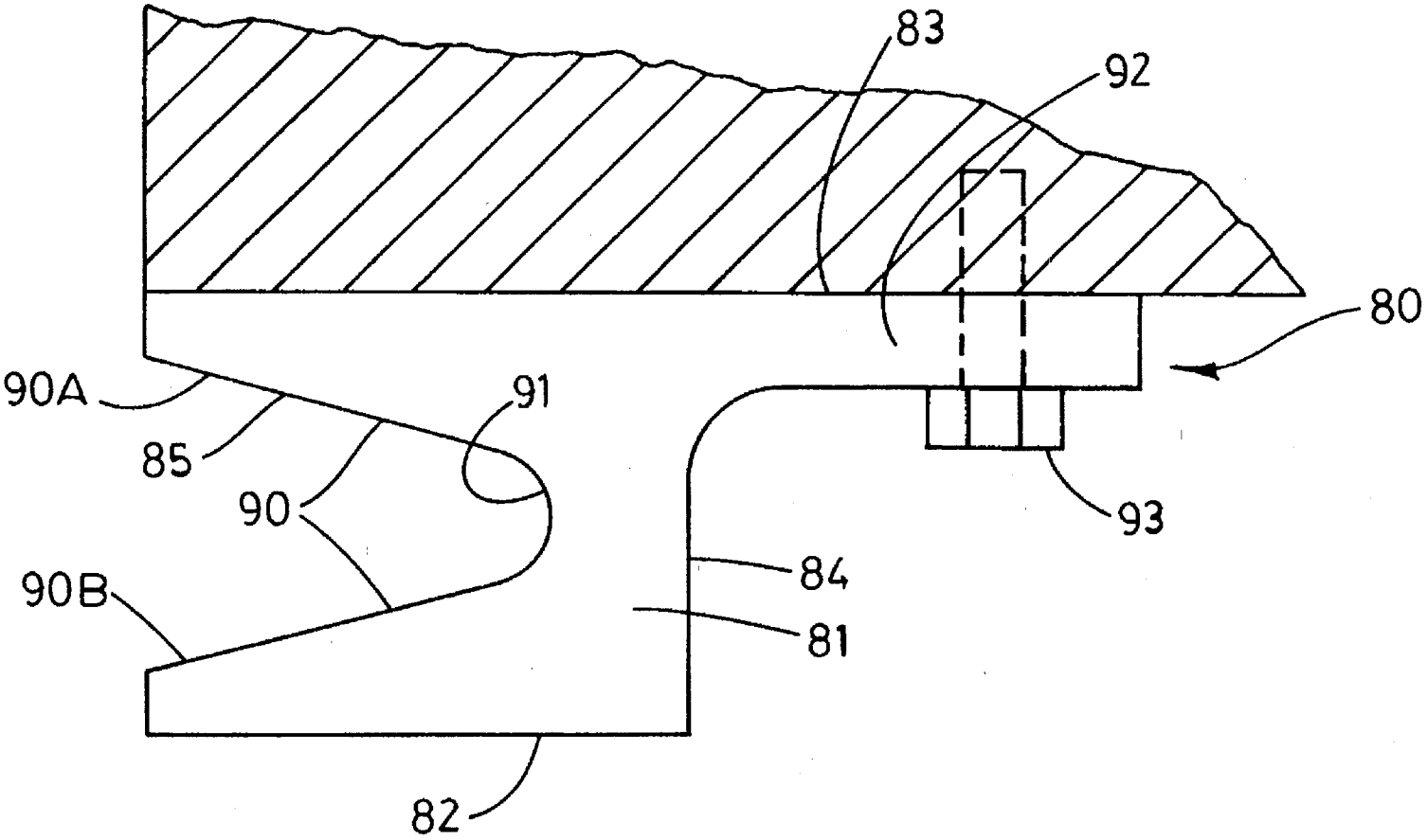
FIG. 5 is a fragmentary, vertical, sectional view of a second form of the overhead door of the present invention, and which shows an alternate design for the associated track.

A second form 80 of the pair of tracks 40 is best seen by reference to FIG. 5. The second form of the respective tracks facilitates release of the overhead door 10 when force of a predetermined magnitude is applied in opposite directions. As shown therein, the second form of the tracks includes a main body 81, which also has forwardly and rearwardly facing surfaces 82 and 83, and outwardly and inwardly facing, laterally oriented surfaces 84 and 85, respectively. As best seen in FIG. 5, the inwardly facing surfaces defines a pair of engagement surfaces 90 which slope inwardly from the forwardly and rearwardly facing surfaces, and which provide a pair of surfaces 90A and 90B which cooperate with the release assembly. This interaction with the release assembly will be discussed in greater detail hereinafter. Further, the engagement surfaces define a substantially u-shaped channel 91 which is disposed in a substantially intermediate position between the forwardly and rearwardly facing surfaces 82 and 83, respectively and which extends longitudinally relative to the main body. Additionally, the main body 81 has a flange portion 92 which extends substantially normally outwardly therefrom and which provides a means whereby a fastener 93 may engage same and thereby secure it on the underlying wall or bulkhead 12.

Figure 4:
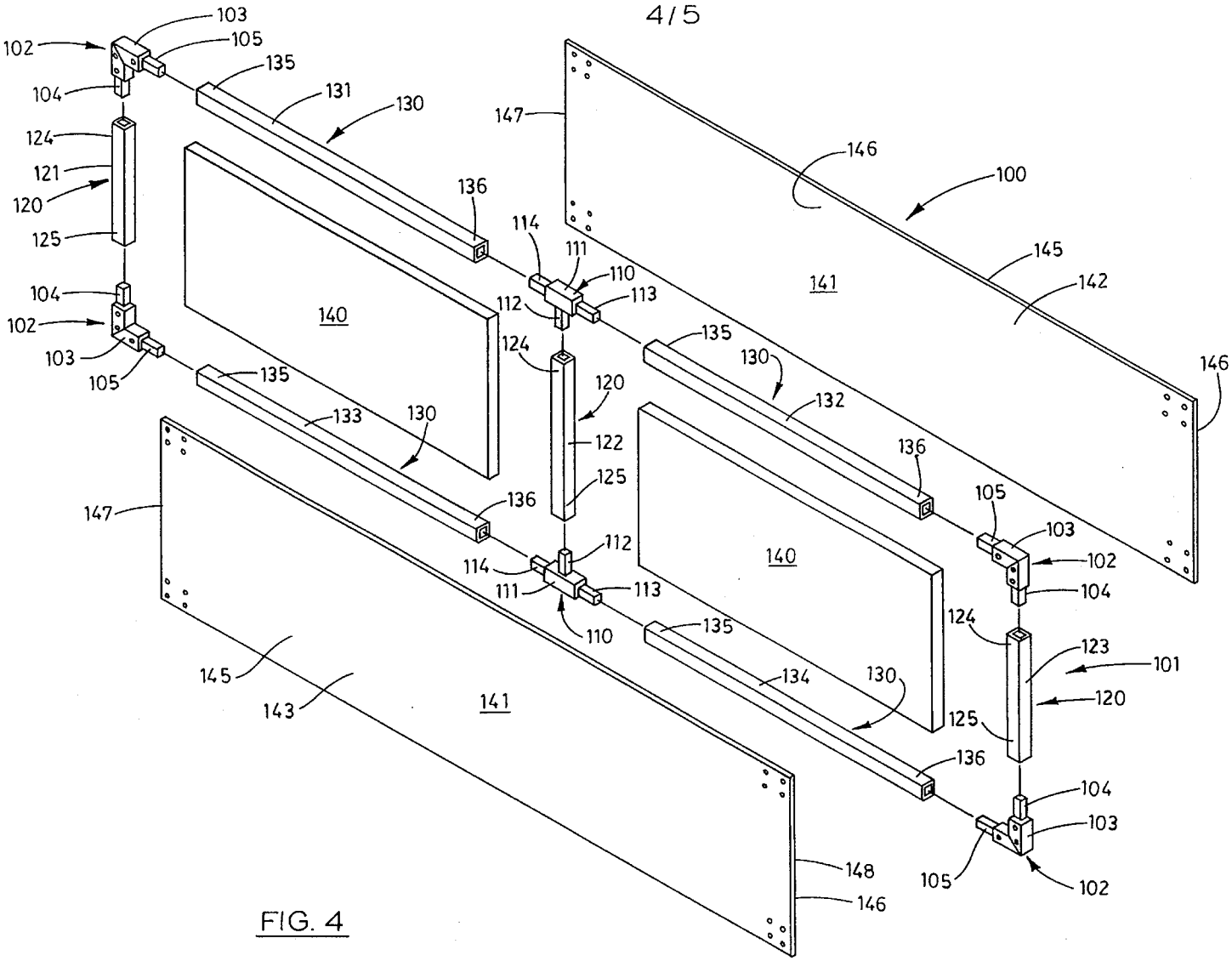
FIG. 4 is a perspective, fragmentary, exploded view of a door panel which is utilized with the overhead door of the present invention.

As best seen by reference FIG. 4, and as will be appreciated by a study of FIG. 1, the overhead door 10 of the present invention includes a plurality of door panels 100. The door panels are disposed in a location intermediate the pair of tracks 40. The individual door panels are substantially identical, and therefore, for purposes of brevity, only one panel is discussed herein.

The individual door panels 100 each have a frame 101 which is best seen by reference to FIG. 4. The frame 101 includes four corner portions which are each designated by the numeral 102. The individual corner portions each have a main body 103 which has a first leg 104, and a second leg 105, which are respectively oriented in substantially normal relation one to the other. As best understood by reference to FIG. 4, the individual legs have cross-sectional dimensions which are less than the cross-sectional dimension of the main body. Further, each of the legs have a cross-sectional shape which is substantially square. Positioned, or oriented between the individual corner portions are a pair of central, connector portions, which are designated by the numeral 110. The central connector portions each have a T-shaped main body 111 which has a first leg 112, and second and third legs 113, and 114 respectively. The second and third legs are substantially coaxial aligned, and are oriented in substantially normal relation relative to the first leg 112. The first, second and third legs are substantially square, and have a cross-sectional dimension which is less than the cross-sectional dimension of the main body 111.

Three substantially vertically oriented support members, and which are generally indicated by the numeral 120, are operable to interconnect or join the corner portions 102 and the central connector portions 110, respectively, together. The three substantially vertically oriented support members are designated by the numerals 121, 122 and 123, respectively. The individual support members, which are substantially identical in their length dimension, have a first end 124, and an opposite, second end 125. Further, and as will be recognized in the exploded view of FIG. 4, the individual members 121, 122, and 123 respectively have internal cross-sectional dimensions which are just slightly greater than the outside cross-sectional dimensions of the individual legs 104. As will appreciated, each of the first legs 104, and 112, respectively, telescope internally of the respective support members 121, 122, and 123 thereby providing vertical supports for the individual door panels 100. The frame 101 further has four horizontally oriented support members which are designated generally by the numeral 130. The horizontal support members are further individually designated by the numerals 131, 132, 133 and 134 respectively. These individual horizontal support members also have a first end 135, and an opposite, second end 136. Each of the horizontal support members have an inside cross-sectional dimension which is greater than the outside cross-sectional dimensions of the individual second legs 105, 113, and 114 respectively. This, of course, permits the respective second legs to telescopingly engage the individual horizontal members thereby providing a narrowly rectangular and rigid frame 101. It should be understood that the frame 101 can be manufactured from a number of different materials including natural, and man-made, however, it will be recognized that advantages will be gained if the frame of the present door panel is fabricated from a lightweight, yet high strength material such as fiberglass, or an extrudible polymeric-based material. Further, various fastening means may be utilized to secure the individual parts of the frame 101 together. These fastening means may include all manner of screw-type fasteners, as well as adhesives, welding, or the like.

As will be appreciated by a study of FIG. 4, a pair of insulating/sound proofing sheets 140 are sandwiched between the various horizontal and vertical frame members 120 and 130 respectively, and which provide improved performance characteristics for the individual door panels 100. As will be appreciated, the pair of insulation sheets 140 have length, width and height dimensions which are substantially identical to the dimensional characteristics of the area which is defined between the individual frame members 120 and 130. A pair of exterior facing cover panels 141 are provided. The cover panels 141 include a front, or first panel 142, and a second or rear panel 43. As best seen by reference to FIG. 1, three hinges 144, of conventional design, are provided and which operate to join the individual door panels 100 together thereby providing an overhead door 10 which has an articulated design. The individual cover panels 141 may be manufactured from natural or synthetic materials, however, a preferably high-strength, lightweight material would be desirable. The individual cover panels further have an exterior surface 145, and an interior surface 146.

Additionally, the exterior surface has a left lateral edge 147 and a right lateral edge 148.

Figure 2:
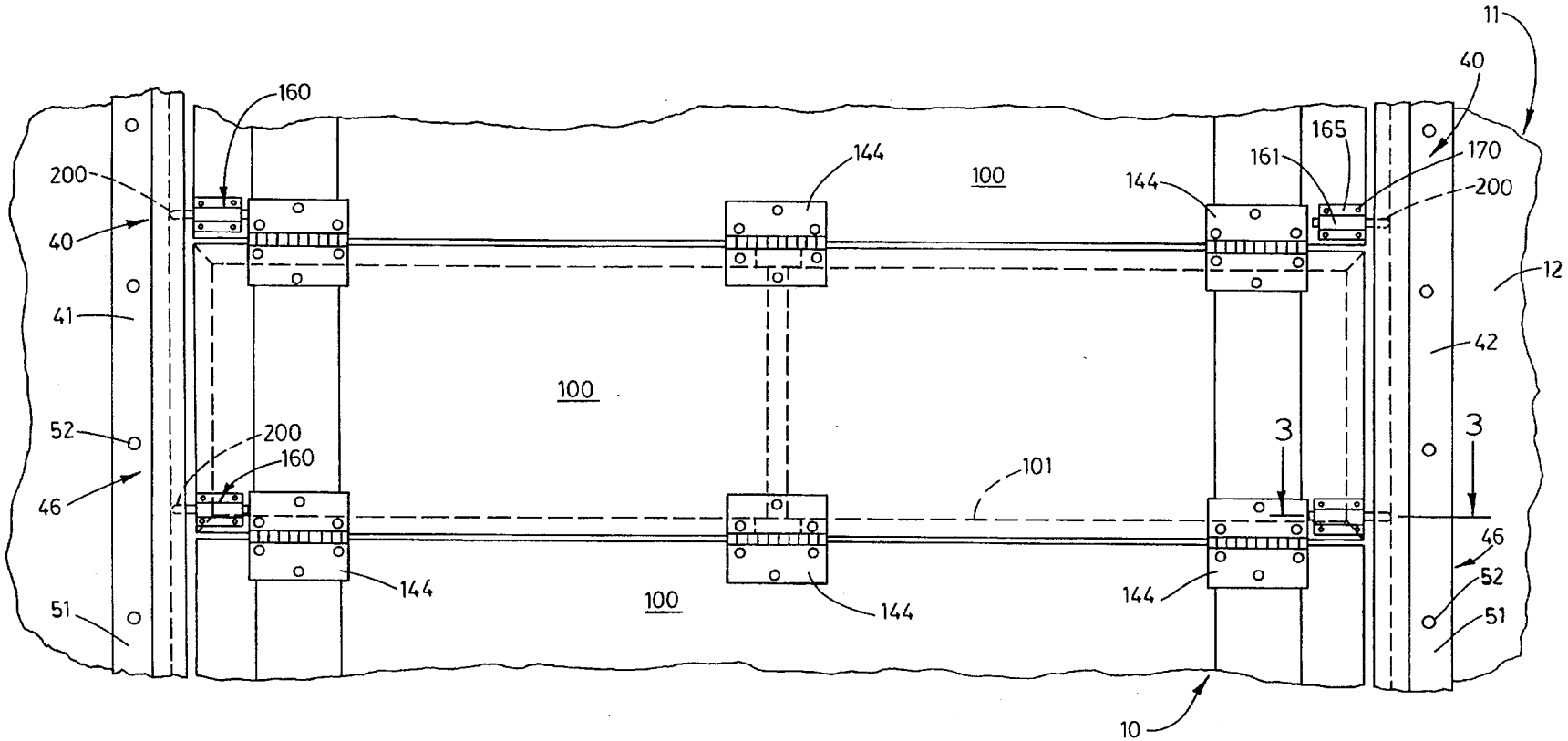
FIG. 2 is a fragmentary, side elevational view of the overhead door of the present invention and which is taken from a position along line 2—2 of FIG. 1.

As best seen by reference to FIGS. 1 and 3, the overhead door 10 is operable to be released, upon exposure to force of a predetermined magnitude, from the accompanying track 40 by means of a release assembly, which is generally indicated by the numeral 160. As best seen by reference to FIG. 2, a pair of release assemblies are individually mounted in close proximity to the left and right lateral edges 147 and 148 respectively. While a pair of release assemblies are shown in the drawings, it will be recognized that four release assemblies may be used in some applications due, in part, to the size of the door panel employed. The individual release assemblies include a housing 161 which is defined by a side wall 162. The housing further includes a front wall 163, and a rear wall 164, which are disposed in predetermined substantially parallel, spaced relation one to the other. A flange 165 is made integral with the housing 161, and further includes a plurality of apertures 165A which are positioned in a predetermined pattern and which accommodate individual fasteners 170 which are operable to matingly engage the underlying door panels 100. The fasteners may be manufactured from a frangible material which will shatter or otherwise break when exposed to a shearing force of a predetermined magnitude. These fasteners provide additional safety against damage to the overhead door assembly 10 when force is applied in an incorrect direction to the overhead door. The side wall, and front and rear walls each have an exterior facing surface 171, and an opposite, interior facing surface 172. Further, an aperture 173 of predetermined dimensions is formed in the rear wall. Additionally, a front aperture 174 is defined by the front wall These apertures 173 and 174 are substantially coaxially aligned. As best appreciated by a study of FIG. 3, the rear aperture has a predetermined diametral dimension, and the front aperture has a diametral or cross-sectional dimension which is greater than the rear aperture. The interior facing surface 172 defines a cavity 175 which encloses the internal mechanism of the release assembly and which will be discussed in the paragraph which follows.

The housing 161 encloses a plunger assembly which is generally indicated by the numeral 180. The plunger assembly has a main body 181 which has a threaded shaft portion 182, and further has a head 183 mounted on the distal end thereof. The threaded shaft portion has a first end 184, and an opposite, second end 185. As best seen in FIG. 3, the main body of the plunger assembly is sideably received in the coaxial aligned apertures 173 and 174, respectively, and is reciprocally moveable along a path of travel which will be discussed in greater detail hereinafter. As best seen in FIG. 3, a pair of nuts 190 threadably engage the threaded shaft portion and are located in a predetermined location along the threaded shaft. Further, a washer, 191 of substantially conventional design, is received about the threaded shaft and is positioned between the head 183 and the pair of nuts 190. A biasing spring 193 is biased between the rear wall 164 and the washer 191. It should be understood that the spring 193 is operable to urge the head 183 in the direction of the rear wall. Further, the movement of the individual nuts in the direction of the head is operable to compress the biasing spring thereby causing increased force to be applied to the threaded shaft. The individual nuts operate as a stop member, and further provide a convenient means for adjusting the amount of force which is necessary to dislodge the overhead door 10 from the pair of tracks 40.

A plunger 200 is releasably fixed on the threaded shaft portion 182 of the main body 181. The plunger has a main body 201 which has a first end 202, which engages the respective tracks 40. The second end 203 of the plunger has a threaded channel 204 formed therein and which is operable to threadably mate with the threaded shaft portion 182. The plunger assembly is reciprocally moveable along a predetermined path of travel 210 from a first, engaged, or extended position 211, as shown in FIG. 3, where it is operable to be received in the u-shaped channel 71 of the individual tracks 40; to a second, depressed, or releasing position 212, such as what is shown in phantom lines in FIG. 3. In the second position, the plunger assembly is urged backwardly against the force of the biasing spring 193. When located in the second position, the plunger may be urged upwardly along the engagement surface 72 following the application of force of a predetermined magnitude to the door panel 100. As should be understood, when force continues to be applied to the overhead door 10, the plunger assembly is forced rearwardly until the door panel 100 is released from the track 40 thereby avoiding damage to the overhead door 10, the track 40, or any surrounding assemblies or structures. To reset the overhead door in the respective tracks 40, an individual would merely grasp the head 183 of the main body 181, and pull it rearwardly thereby permitting the plunger 200 to be moved into engagement with the u-shaped channel 71 which is defined by the track 60. As will be appreciated, biasing springs of different strengths can be selected to provide an overhead door 10 which can release when force of different magnitudes are applied to same.

OPERATION

The operation of the described embodiment of the present invention is believed to be readily apparent and is briefly summarized at this point. The overhead door assembly 10 of the present invention includes a pair of tracks 40 which are mounted on a structure such as a wall or bulkhead 12. Each of the tracks have an inwardly facing surface 65 which defines a channel 71 and wherein the individual channels are mounted in predetermined substantially parallel spaced relation one to the other. An individual door panel 100 is located intermediate the pair of tracks and is moveable along a predetermined path of travel 40A which is defined by the pair of tracks. A release assembly, and which is generally indicated by the numeral 160, is borne by the door panel and is operable to releasably engage at least one of the tracks. The release assembly includes a movable plunger assembly 180 which is received in the channel of one of the tracks and which guides the door panel along the path of travel. The door panel becomes disengaged from the channel when force of a predetermined magnitude, and direction is applied to the door panel. As earlier discussed, and depending upon the track assembly which is employed, force of a predetermined magnitude which is applied in a specific direction may, or may not, cause the release of the overhead door 10 from the associated track. For example, in the first form of the track 60, the force of a predetermined magnitude must be applied in a specific direction in order to cause the door panel to move to a disengaged orientation relative to the track 40. Further, the second form of the track 80 is operable to release when force is applied in either direction to the overhead door. As should be understood, the tracks which are employed with a specific overhead door may include tracks which have either one profile or the other or a combination of both, that is, the upper and lower portions 45 and 46 of the first and second forms of the tracks earlier discussed. This would provide an overhead door which would release in predetermined directions if struck at predetermined distances above the surface of the floor 15.

Therefore, it will be seen that the overhead door 10 of the present invention provides a convenient means whereby an overhead door 10 may be rendered releasable from a pair of associated tracks 40 following exposure to force of a predetermined magnitude thereby preventing damage to the tracks, overhead door, and surrounding structure, and further provides a convenient means whereby a light-weight, and reliable overhead door assembly may be manufactured for use in all manner of commercial environments, can be fabricated and installed, as original construction, or manufactured in the nature of a retrofit, and which further can be assembled at a greatly reduced cost in relative comparison to prior-art assemblies which have been designed for substantially identical purposes in view of its simplicity of design.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desire to secure by Letters Patent of the United States is:

1. An overhead door for a structure, the overhead door comprising:

a pair of tracks capable of being mounted on the structure, each of the tracks having an inwardly facing, substantially smooth engagement surface having an angled disengagement portion and a u-shaped channel, and wherein the individual u-shaped channels are capable of being positioned in predetermined substantially parallel relation, one to the other, the angled disengagement portion continuing smoothly to a disengagement point;

a substantially rigid door panel capable of being located intermediate the pair of tracks, and movable along a predetermined path of travel which is defined by the pair of tracks; and a release assembly borne by the substantially rigid door panel and operable to releasably engage at least one of the tracks, the release assembly including a substantially rigid plunger borne by the substantially rigid door panel, the plunger having a proximal end, and a distal end, which is received in the u-shaped channel of one of the tracks, the plunger being reciprocally moveable along a predetermined linear path of travel from a first, engaged position, wherein the distal end of the plunger is received in the u-shaped channel, to a second, retracted position wherein the distal end of the plunger is displaced from the u-shaped channel, the plunger capable of guiding the substantially rigid door panel along its predetermined path of travel, and further being capable of disengaging from the u-shaped channel, moving along the angled disengagement portion of the engagement surface to disengage from the at least one of the tracks when force of a predetermined magnitude is applied to the substantially rigid door panel; and means borne by the substantially rigid door panel for biasing the plunger into the first, engaged position.

2. An overhead door as claimed in claim 1, and wherein each of the tracks has a main body which includes forwardly and rearwardly disposed surfaces, and inwardly and outwardly disposed surfaces and wherein the rearwardly disposed surface is positioned in juxtaposed relation relative to the structure and wherein each of the inwardly disposed surfaces define the engagement surface, and wherein the u-shaped channel is located adjacent the rearwardly disposed surface, and wherein the thickness dimension of the rearwardly disposed surface is less than the thickness dimension of the forwardly disposed surface, and wherein the engagement surface slopes inwardly toward the u-shaped channel from the forwardly disposed surface.

3. An overhead door as claimed in claim 1, and wherein each of the tracks has a main body which includes forwardly and rearwardly disposed surfaces, and inwardly and outwardly disposed surfaces and wherein the rearwardly disposed surface is positioned in juxtaposed relation relative to the structure and wherein each of the inwardly disposed surfaces defines the engagement surface, and wherein the u-shaped channel is located adjacent the forwardly disposed surface, and wherein the thickness dimension of the forwardly disposed surface is less than the rearwardly disposed surface, and wherein the engagement surface slopes inwardly toward the u-shaped channel from the rearwardly disposed surface.

4. An overhead door as claimed in claim 1, and wherein each of the tracks has a main body which includes forwardly and rearwardly disposed surfaces, and inwardly and outwardly disposed surfaces and wherein the rearwardly disposed surface is positioned in juxtaposed relation relative to the structure and wherein the inwardly disposed surface of each of the tracks defines the engagement surface, and wherein the u-shaped channel is positioned intermediate the forwardly and rearwardly disposed surfaces of the tracks, and wherein the thickness dimension of the forwardly and rearwardly disposed surfaces are substantially equal, and wherein the engagement surface slopes inwardly toward the u-shaped channel.

5. An overhead door for a structure, the overhead door comprising:

a pair of tracks mounted on the structure, each of the tracks having a substantially smooth engagement surface having an angled portion and a u-shaped channel, and wherein the individual u-shaped channels are positioned in predetermined substantially parallel relation, one to the other;

a substantially rigid door panel located intermediate the pair of tracks, and movable along a predetermined path of travel which is defined by the pair of tracks; and a release assembly borne by the substantially rigid door panel and operable to releasably engage at least one of the tracks, the release assembly including a housing mounted on the door panel and defining a cavity; a plunger movably borne by the housing, and received in the cavity, the plunger having a proximal end which is received in the housing, and a distal end, which is received in the u-shaped channel of one of the tracks, and wherein the plunger is reciprocally moveable along a predetermined path of travel from a first, engaged position, wherein the distal end of the plunger is received in the u-shaped channel, to a second, retracted position wherein the distal end of the plunger is displaced from the u-shaped channel; and means borne by the housing for biasing the plunger into the first, engaged position;

and wherein the plunger has a main body which includes a threaded passageway, and wherein a threaded shaft is reciprocally borne by the housing and received in the cavity, and wherein the threaded shaft threadably engages the plunger, and wherein a nut threadably engages the threaded shaft and is positioned intermediate its opposite ends, and wherein the biasing means includes a spring which is received about the threaded shaft, and is biased between the housing and the nut, the spring urging the plunger into the first, extended position.

6. An overhead door for selectively occluding an opening in a structure, the overhead door comprising:

a pair of tracks individually borne on opposite sides of the opening, the individual tracks each having a main body which includes forwardly and rearwardly facing surfaces, and laterally disposed, inwardly and outwardly facing surfaces, and wherein the inwardly facing surfaces of each of the tracks have engagement surfaces which define a u-shaped channel which extends substantially longitudinally relative to each of the tracks;

a substantially rigid door panel positioned between the tracks and operable to selectively occlude the opening of the structure;

a housing mounted on the door panel;

a plunger movably borne by the housing and having a distal end which is movably received in the u-shaped channel of at least one of the tracks, and wherein the plunger is reciprocally moveable along a predetermined linear path of travel from a first, engaged position, wherein the distal end of the plunger is positioned in the u-shaped channel, to a second, retracted position wherein the distal end of the plunger is displaced from the u-shaped channel; and means borne by the housing for biasing the plunger into the first engaged position, and wherein force applied to the door panel causes the plunger to move from the first, engaged position, to the second, retracted position thus allowing the door panel to disengage from the track; and wherein the plunger has a main body which includes a passageway, and wherein a shaft is reciprocally borne by the housing and engages the passageway, and wherein the shaft includes a stop member, and wherein the biasing means includes a spring which is received about the shaft and biased between the stop member and the housing, the spring biasing the plunger into the first, extended position.

7. The overhead door as claimed in claim 6, and wherein the u-shaped channel is located adjacent the rearwardly facing surface, and wherein the forwardly facing surface has a given thickness dimension, and the rearwardly facing surface has a thickness dimension less than the forwardly facing surface, and wherein the laterally disposed, inwardly facing surface slopes inwardly from the forwardly facing surface towards the u-shaped channel.

8. An overhead door as claimed in claim 8, and wherein the u-shaped channel is located substantially intermediate the forwardly and rearwardly facing surfaces of the tracks, and wherein the rearwardly joining surface is disposed in juxtaposed relation relative to the structure and wherein the thickness dimension of the forwardly and rearwardly facing surfaces are substantially equal, and wherein the inwardly facing surface slopes inwardly from the forwardly and rearwardly facing surfaces toward the u-shaped channel.

9. An overhead door for a structure comprising:

a pair of tracks mounted on the structure, each of the tracks having an inwardly facing surface which defines a channel, and wherein the individual channels are mounted in predetermined substantially parallel relation one to the other;

a door panel located between the pair of tracks and moveable along a predetermined path of travel which is defined by the pair of tracks; and a release assembly borne by the door panel and operable to releasably engage at least one of the tracks, the release assembly including a moveable plunger which is received in the channel of one of the tracks, and wherein the plunger has a proximal end which is received in the housing, and a distal end which is received in the channel, and wherein the plunger is reciprocally moveable along a predetermined path of travel from a first engaged position, wherein the distal end of the plunger is received in the channel, to a second, retracted position wherein the distal end of the plunger is displaced from the channel, and wherein the plunger has a main body which includes a threaded passageway, and wherein a threaded shaft is reciprocally borne by the housing and received in the cavity, and wherein the threaded shaft threadably engages the plunger and wherein a nut threadably engages the threaded shaft and is located in a position intermediate its opposite ends, and wherein a biasing means including a spring is received about the threaded shaft and is biased between the housing and the nut, the spring urging the plunger into the first extended position, and wherein the plunger moves along the path of travel and further disengages from the channel when force of predetermined magnitude is applied to the door panel.

10. An overhead door for selectively occluding an opening in a structure, the overhead door comprising:

a pair of tracks individually borne on opposite sides of the opening, the individual tracks each having a main body which includes forwardly and rearwardly facing surfaces, and laterally disposed, inwardly and outwardly facing surfaces, and wherein the inwardly facing surfaces of each of the tracks have engagement surfaces which define a u-shaped channel which extends substantially longitudinally relative to each of the tracks;

a plurality of substantially rigid door panels positioned between the tracks and operable to selectively occlude the opening of the structure;

at least one housing mounted on each of the substantially rigid door panels;

a plunger borne by each of the housings and having a distal end which is movably received in the u-shaped channel of at least one of the tracks and wherein the plunger is reciprocally moveable along a predetermined linear path of travel from a first, engaged position wherein the distal end of the plunger is positioned in the u-shaped channel to a second, retracted position, wherein the distal end of the plunger is displaced from the u-shaped channel;

a shaft reciprocally borne by each of the housings and made integral with each of the plungers, and wherein the shaft includes a stop member; and means borne by the each of the housings for biasing each of the plungers into the first, engaged position, and wherein the biasing means includes a spring which is received about the shaft and biased between the stop member and the housing, and wherein force applied to any one of the substantially rigid door panels causes the plunger of the forced, substantially rigid door panel to move from the first, engaged position to the second, retracted position, allowing the forced, substantially rigid door panel to disengage from the track.

11. An overhead door for a structure, the overhead door comprising:

a pair of tracks capable of being mounted on the structure, each of the tracks having a substantially smooth engagement surface having an angled portion and a u-shaped channel, and wherein the individual u-shaped channels are capable of being positioned in predetermined substantially parallel relation, one to the other;

a plurality of substantially rigid door panels capable of being mounted intermediate the pair of tracks, each movable along a predetermined path of travel which is defined by the pair of tracks; and at least one release assembly borne by each of the substantially rigid door panels and operable to releasably engage at least one of the tracks, each release assembly including:

a housing mounted on one substantially rigid door panel;

a substantially rigid plunger movable along a linear path of travel having a proximal end received in the housing, a distal end received in the u-shaped channel of one of the tracks, and a main body which includes a stop member, the movable plunger capable of guiding the door panel along its predetermined path of travel, and which further disengages from the u-shaped channel, moves along the angled portion of the engagement surface, and disengages from the at least one of the tracks when force of a predetermined magnitude is applied to the door panel; and means borne by the housing for biasing the plunger into the first, engaged position, and which is biased between the housing and the stop member.

* * * * *

UNITED STATES PATENT AND TRADEMARK OFFICE

CERTIFICATE OF CORRECTION

PATENT NO. : 5,535,805
DATED : July 16, 1996
INVENTOR(S) : Kurt A. Kellogg et al.

It is certified that error appears in the above-identified patent and that said Letters Patent is hereby corrected as shown below:

Column 11,
Line 47, the claim reference numeral "8" should read -- 6 --.

Signed and Sealed this

Twenty-second Day of March, 2005

JON W. DUDAS
*Director of the United States Patent and Trademark Office*